US009093060B2

(12) United States Patent
Mori et al.

(10) Patent No.: US 9,093,060 B2
(45) Date of Patent: Jul. 28, 2015

(54) SOUND-PROOF MATERIAL AND PROCESS FOR PRODUCTION THEREOF, SOUND-PROOF MOLDING, AND SOUND INSULATION METHOD

(75) Inventors: Tadashi Mori, Tokyo (JP); Takahiro Niwa, Tokyo (JP); Masaki Yoshihara, Tokyo (JP); Motonori Kondoh, Tokyo (JP); Kaname Arimizu, Tokyo (JP)

(73) Assignee: NICHIAS CORPORATION, Tokyo (JP)

( * ) Notice: Subject to any disclaimer, the term of this patent is extended or adjusted under 35 U.S.C. 154(b) by 10 days.

(21) Appl. No.: 13/982,110

(22) PCT Filed: Jan. 26, 2012

(86) PCT No.: PCT/JP2012/051691

§ 371 (c)(1),
(2), (4) Date: Oct. 4, 2013

(87) PCT Pub. No.: WO2012/102345

PCT Pub. Date: Aug. 2, 2012

(65) Prior Publication Data

US 2014/0027200 A1 Jan. 30, 2014

(30) Foreign Application Priority Data

Jan. 26, 2011 (JP) ..... 2011-014515

(51) Int. Cl.
*E04B 1/84* (2006.01)
*F02B 77/13* (2006.01)
(Continued)

(52) U.S. Cl.
CPC ..... *G10K 15/00* (2013.01); *G10K 11/168* (2013.01); *Y10T 156/1002* (2015.01)

(58) Field of Classification Search
USPC ..... 181/290, 286, 291, 284, 204, 205
See application file for complete search history.

(56) References Cited

U.S. PATENT DOCUMENTS 4,488,619 A * 12/1984 O'Neill ..... 181/290
4,966,799 A * 10/1990 Lucca et al. ..... 428/95
(Continued)

FOREIGN PATENT DOCUMENTS

CN 101387225 A 3/2009
EP 1 710 126 A1 4/2005
(Continued)

OTHER PUBLICATIONS

CN Office Action and English translation in CN 201280006688.3 dated Jun. 30, 2014.
(Continued)

*Primary Examiner* — Edgardo San Martin
(74) *Attorney, Agent, or Firm* — Nixon & Vanderhye P.C.

(57) ABSTRACT

The present invention relates to a sound-proof material containing a first sound-absorbing material disposed facing a sound source, a first soft sound-insulating layer laminated on a face of the first sound-absorbing material opposite to the sound source and having an air permeability measured in accordance with JIS L1018 of 10 cc/cm$^2$·sec or lower, a second sound-absorbing material laminated on the first soft sound-insulating layer, and a second soft sound-insulating layer laminated on the second sound-absorbing material and having an air permeability measured in accordance with JIS L1018 of 10 cc/cm$^2$·sec or lower and a Young's modulus measured in accordance with JIS K7127 greater than or equal to five times that of the first soft sound-insulating layer, in which at least the second soft sound-insulating layer is partially or entirely bonded to the second sound-absorbing material.

9 Claims, 6 Drawing Sheets

(51) Int. Cl.

| | |
|---|---|
| ***G10K 11/168*** | (2006.01) |
| ***G10K 15/00*** | (2006.01) |
| *E04B 1/82* | (2006.01) |
| *F02B 77/11* | (2006.01) |
| *G10K 11/16* | (2006.01) |

(56) References Cited

U.S. PATENT DOCUMENTS

| | | | | |
|---|---|---|---|---|
| 5,153,388 | A * | 10/1992 | Wittenmayer et al. | 181/290 |
| 5,304,415 | A * | 4/1994 | Kurihara et al. | 428/328 |
| 5,504,282 | A * | 4/1996 | Pizzirusso et al. | 181/290 |
| 6,145,617 | A * | 11/2000 | Alts | 181/290 |
| 7,320,739 | B2 * | 1/2008 | Thompson et al. | 156/308.2 |
| 7,322,440 | B2 * | 1/2008 | Khan et al. | 181/286 |
| 7,410,030 | B2 * | 8/2008 | Fusiki et al. | 181/286 |
| 7,677,358 | B2 * | 3/2010 | Tocchi et al. | 181/290 |
| 7,770,692 | B2 | 8/2010 | Hazelton et al. | |
| 7,963,363 | B2 * | 6/2011 | Niwa et al. | 181/290 |
| 8,051,950 | B2 * | 11/2011 | Alston | 181/294 |
| 8,091,684 | B2 * | 1/2012 | Juriga | 181/286 |
| 8,157,051 | B2 * | 4/2012 | Marcel et al. | 181/290 |
| 8,418,806 | B1 * | 4/2013 | Wyerman et al. | 181/290 |
| 8,464,830 | B2 * | 6/2013 | Ishikawa et al. | 181/290 |
| 8,496,088 | B2 * | 7/2013 | Kitchen et al. | 181/290 |
| 8,590,670 | B1 * | 11/2013 | Grube et al. | 181/291 |
| 8,695,757 | B2 * | 4/2014 | Duval et al. | 181/290 |
| 2008/0017445 | A1 * | 1/2008 | Katz | 181/290 |
| 2008/0257641 | A1 | 10/2008 | Tocchi et al. | |
| 2009/0071747 | A1 | 3/2009 | Hazelton et al. | |
| 2009/0250292 | A1 * | 10/2009 | Hayasaka et al. | 181/290 |
| 2009/0250293 | A1 * | 10/2009 | Gleine et al. | 181/292 |
| 2010/0101891 | A1 * | 4/2010 | Kamikawa | 181/290 |
| 2011/0139542 | A1 * | 6/2011 | Borroni | 181/290 |

FOREIGN PATENT DOCUMENTS

| | | | |
|---|---|---|---|
| JP | 61-154831 | A | 7/1986 |
| JP | 10-205352 | | 8/1998 |
| JP | 2001-347900 | | 12/2001 |
| JP | 2002-178397 | A | 6/2002 |
| JP | 2005-208494 | | 8/2005 |
| JP | 2005-227747 | | 8/2005 |
| JP | 2006-098966 | | 4/2006 |
| JP | 2009-090845 | A | 4/2009 |
| JP | 2010-036675 | | 2/2010 |

OTHER PUBLICATIONS

Japanese Office Action in counterpart JP Application SN 2012-554840 dated Aug. 26, 2014.

International Search Report for PCT/JP2012/051691, mailed Mar. 19, 2012.

* cited by examiner

SOUND-PROOF MATERIAL AND PROCESS FOR PRODUCTION THEREOF, SOUND-PROOF MOLDING, AND SOUND INSULATION METHOD

This application is the U.S. national phase of International Application No. PCT/JP2012/051691, filed 26 Jan. 2012, which designated the U.S. and claims priority to Japan Application No. 2011-014515, filed 26 Jan. 2011, the entire contents of each of which are hereby incorporated by reference.

TECHNICAL FIELD

The present invention relates to a sound-proof material to be fitted to automobile engines, wall materials in buildings or the like, and a process for production thereof, a sound-proof molding, and a sound insulation method.

BACKGROUND ART

There are a large number of sound sources in an automobile. From the viewpoint of the demand for quietness away from automotive inside and outside noises, various sound-proof measures have been taken. In particular, with regard to the components (peculiar noise sources) that generate loud sounds, such as engines, transmissions and driving systems, sound-proof measures are required in the positions near to the sound sources. Thus, a dedicated sound-proof cover excellent in sound-absorbing and insulating performance is used. Combined with the tightening of automotive outside noise level regulations due to a series of legal changes and the fact that a reduction in automotive inside noise is directly linked to a car value (a touch of class), the demand for noise-reducing components in automobiles is very high. In particular, an automotive outside noise regulation scheduled to be introduced in the European Union in 2013 is finally as severe as −0.3 dB to the conventional regulation value (it is necessary to be reduced to one half in terms of sound pressure energy). This essentially requires noise reduction measures against the peculiar noise sources such as basic engines and transmissions as main noise emitting sources in an engine room. Although various sound-proof components such as engine top covers on the side of upper surfaces of engines have hitherto been used, however, further improvement in performance has been demanded. Further, from the viewpoint of a decrease in fuel consumption, weight saving have also been demanded.

Conventional sound-proof covers are designed with putting the principal objective thereof to insulation of direct noise emitted from the peculiar noise sources, and have structures in which a sound-absorbing material is post-attached to the peculiar noise source side of a rigid cover or to a part thereof, which is formed by molding a metal or a resin such as polyamide or polypropylene (see Patent Document 1). However, the sound-insulating performance of such a sound-proof cover conforms to the mass law, and depends on the weight of the rigid cover. It is therefore impossible to comply with the needs for weight saving. Further, in the case where the peculiar noise source is accompanied by vibration, even when the vibration is transmitted from fixing points and the like for attaching the sound-proof cover to the engine and the like, the rigid cover hardly undergoes vibration-induced deformation, and hence an effect of damping the vibration as kinetic energy cannot be obtained. Accordingly, secondary emission occurs from a rigid noise insulating layer to rather deteriorate the noise level in some cases.

Moreover, regarding the evaluation of noises inside and outside an automobile, since the noise level itself is an amount of sense of human, a sound pressure level (dB) obtained by logarithmically compressing an observed sound pressure is used as a criterion close to an amount of the sound sensed by human. However, when a four (multi)-directional average (combination sound) which is generally employed in a case of evaluating a general sound-proofing effect (the increase or decrease in sound pressure level) is considered, the largest sound of all the measured sounds exerts a large influence because of the characteristic of the dB sum calculation. Therefore, even though the sound pressure level in only one direction in which a sound-proof measure has been taken is reduced, the sound-proof effect could not be attained as a whole with the result that the sound pressure level that is an amount of human sense could not be lowered in some cases. Accordingly, it is necessary to thoroughly and uniformly reduce the sound pressure level in every direction.

However, with the sound-proof cover disclosed in Patent Document 1 having a structure in which a sound-absorbing material is attached to a rigid cover, the rigid cover may be resonant with vibration transmission (solid-borne sounds) in case where the peculiar noise sources is accompanied by vibration, thereby generating noises by itself, that is, causing secondary emission. In general, therefore, it is necessary to be fixed to the peculiar noise sources via a vibration-insulating material such as rubber bush. Therefore, a gap is necessarily formed between the peripheral edge of the sound-proof cover and the peculiar noise source, and there may be a case where inner reverberating sounds (standing waves) leak out from this portion and the sound level reduction cannot be attained.

From such a background, for the purpose of taking measures against solid-borne sounds in the case where the peculiar noise sources is accompanied by vibration or inner reverberating sounds (standing waves) of a sound-proof cover, the present inventors has proposed a sound-proof cover, in which a soft sound-insulating layer formed of a nonwoven fabric coated with a vibration-damping resin is provided, in place of a rigid cover, on a surface of a sound-absorbing material on the opposite side of an peculiar noise source (see Patent Document 2).

However, the sound-proof cover described in Patent Document 2 has a limitation in its mass from a manufacturing problem of the soft sound-insulating layer, and is inferior in sound-insulating performance in a high-frequency region of 4 kHz or more to a high-mass rigid cover in some cases.

CITATION LIST

Patent Literature

Patent Document 1: JP-A-10-205352
Patent Document 2: JP-A-2006-98966

SUMMARY OF THE INVENTION

Problem that the Invention is to Solve

It is therefore an object of the invention is to produce a lightweight sound-proof material more excellent in sound-proof performance than conventional ones, with good productivity.

Means for Solving the Problem

In order to achieve the above object, the present invention provides the following.

(1) A sound-proof material comprising:

a first sound-absorbing material disposed facing a sound source;

a first soft sound-insulating layer laminated on a face of the first sound-absorbing material opposite to the sound source, and having an air permeability measured in accordance with JIS L1018 of 10 cc/cm$^2$·sec or lower;

a second sound-absorbing material laminated on the first soft sound-insulating layer; and a second soft sound-insulating layer laminated on the second sound-absorbing material, and having an air permeability measured in accordance with JIS L1018 of 10 cc/cm$^2$·sec or lower and a Young's modulus measured in accordance with JIS K7127 greater than or equal to five times that of the first soft sound-insulating layer, wherein at least the second soft sound-insulating layer is partially or entirely bonded to the second sound-absorbing material.

(2) The sound-proof material according to the above (1), in which the total of the basis weights of the first sound-absorbing material, the first soft sound-insulating layer, the second sound-absorbing material, and the second soft sound-insulating layer is 2,000 g/m$^2$ or less.

(3) The sound-proof material according to the above (1) or (2), in which the second soft sound-insulating layer is made of a thermoplastic elastomer film.

(4) The sound-proof material according to any one of the above (1) to (3), in which peripheral edges thereof are sealed.

(5) A sound-proof molding obtained by molding the sound-proof material described in any one of the above (1) to (4) into a three-dimensional shape.

(6) A method for producing a sound-proof material comprising:

a laminating step of laminating, on a first sound-absorbing material, a first soft sound-insulating film comprising a thermoplastic resin and having an air permeability measured in accordance with JIS L1018 of 10 cc/cm$^2$·sec or lower, a second sound-absorbing material, and a second soft sound-insulating film comprising a thermoplastic resin and having an air permeability measured in accordance with JIS L 1018 of 10 cc/cm$^2$·sec or lower and a Young's modulus measured in accordance with JIS K7127 greater than or equal to five times that of the first soft sound-insulating film, in this order, to obtain a laminate; and a bonding step of performing a heat process on the obtained laminate, to partially or entirely bond at least the second soft sound-insulating layer and the second sound-absorbing material with each other.

(7) The production method of a sound-proof material according to the above (6), further comprising: a molding step of molding the laminate into a three-dimensional shape after the bonding step.

(8) A method for producing a sound-proof material comprising:

a laminating step of laminating, on a first sound-absorbing material, a first soft sound-insulating film comprising a thermoplastic resin and having an air permeability measured in accordance with JIS L1018 of 10 cc/cm$^2$·sec or lower, a second sound-absorbing material, and a second soft sound-insulating film comprising a thermoplastic resin and having an air permeability measured in accordance with JIS L1018 of 10 cc/cm$^2$·sec or lower and a Young's modulus measured in accordance with JIS K7127 greater than or equal to five times that of the first soft sound-insulating film, in this order, to obtain a laminate; and a bonding step of performing heat-compression on the obtained laminate to mold into a three-dimensional shape and partially or entirely bonding at least the second soft sound-insulating layer and the second sound-absorbing material with each other.

(9) A sound-proof method in which the sound-proof material described in any one of the above (1) to (5) is disposed so that the first sound-absorbing material is in contact with the sound source.

Advantageous Effect of the Invention

The sound-proof material of the present invention damps vibration of sound incident on the first sound-absorbing material disposed facing a sound source by the first soft sound-insulating layer that has a low Young's modulus and is vulnerable to vibration-induced deformation. Further, the vibration of sound that has not been damped in the first soft sound-insulating layer is damped during it penetrates the second sound-absorbing material, and then the vibration of the sound that has not yet been damped is insulated in the second soft sound-insulating layer having higher rigidity than the first soft sound-insulating layer. Thus, it has a further excellent sound-proof property. Further, it is more light-weight as compared with a sound-proof material with a sound-proof cover made of metal or a resin.

In addition, the production method is convenience because the first sound-absorbing material, the first soft sound-insulating film, the second sound-absorbing material, and the second soft sound-insulating film are just laminated and then subjected to heat treatment to bonding. Moreover, the first sound-absorbing material, the first soft sound-insulating film, the second sound-absorbing material, and the second soft sound-insulating film are each provided as a long object, and thus can be laminated while being continuously pulled out, which increases productivity.

MODE FOR CARRYING OUT THE INVENTION

Hereinafter, the present invention will be described in detail with reference to the drawings.

Figure 1:
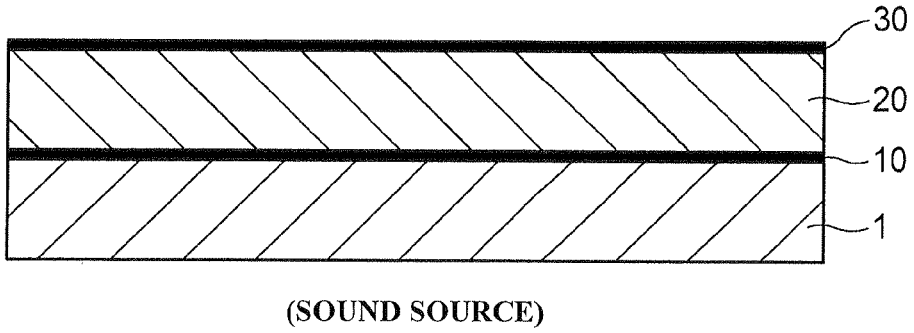
FIG. 1 is a cross-sectional view showing an example of a sound-proof material of the present invention.

FIG. 1 is a cross-sectional view showing an example of a sound-proof material of the present invention. As shown in the drawing, a first sound-absorbing material 1 is disposed facing a sound source (on the lower side of the drawing), and a first soft sound-insulating layer 10, a second sound-absorbing material 20, and a second soft sound-insulating layer 30 are laminated in this order on a face of the first sound-absorbing material 1 opposite to the sound source.

For the first sound-absorbing material 1, a porous material is preferably used. Examples of the porous material include general porous sound-absorbing materials, such as, glass wool, rock wool, rock wool long fibers ("Basalt Fiber" manufactured by Chubu Kougyou Co. Ltd., etc.), polyurethane foam, polyethylene foam, polypropylene foam, phenolic foam, and melamine foam; one obtained by subjecting rubber such as nitrile-butadiene rubber, chloroprene rubber, styrene rubber, silicone rubber, urethane rubber, or EPDM, to foaming in an open cellular state, or one obtained by subjecting them to foaming and then performing a crushing processing or the like to make holes in foam cells into an open cellular state; polyester fiber felt such as polyethylene terephthalate, nylon fiber felt, polyethylene fiber felt, polypropylene fiber felt, acrylic fiber felt, silica-alumina ceramic fiber felt, silica fiber felt ("Siltex" manufactured by Nichias Corporation, etc.), and one (generic name: resin felt) obtained by processing cotton, wool, wood wool, waste fibers, and the like into a felt form with a thermosetting resin.

Further, for the purpose of preventing fibers from scattering and of improving the appearance thereof as products, a flexible nonwoven fabric obtained by forming a single material or a mixture thereof of thermoplastic resin long fibers such as polyethylene long fibers, polypropylene long fibers, nylon long fibers, tetron long fibers, acrylic long fibers, rayon long fibers, vinylon long fibers, fluororesin long fibers such as polyvinyliden fluoride long fibers or polytetrafluoroethylene long fibers, polyester long fibers such as polyethylene terephthalate, and two-layered long fibers in which polyester long fibers are coated with polyethylene resins, to a thin sheet by a spun-bonding method can also be stuck to a surface (the lower surface in the drawing) on the sound source side.

The first soft sound-insulating layer is preferably composed of a film being soft and having a non-air permeating property. The non-air permeating property can be defined using air permeability, which is 10 cc/cm$^2$·sec or less, preferably 0.001 to 10 cc/cm$^2$·sec, and more preferably 0.01 to 1 cc/cm$^2$·sec. Incidentally, the air permeability is a value measured in accordance with JIS L1018-1999.

Flexibility can be defined using a Young's modulus, which is preferably 0.01 to 0.5 GPa, and more preferably 0.02 to 0.12 GPa. Incidentally, the Young's modulus is a value measured in accordance with JIS K7127-1999. Since the first soft sound-insulating layer damps vibration of sound that has penetrated the first sound-absorbing material 1 by deforming itself, it needs to be more flexible, and thus preferably has the above-described Young's modulus value.

In addition, the first soft sound-insulating layer 10 has no limitation on the material thereof as long as the material satisfies the above-described air permeability, and use can be made of nonwoven fabrics, cloths, laminate films, rubber sheets, resin films, vibration-damping resins, vibration-damping rubbers, laminates obtained by appropriately combining them, or nonwoven fabrics or cloths coated with a vibration-damping resin. For implementing the production method to be described later, however, a material that can be fused by heat is preferable, and a thermoplastic resin film used as a hot-melt material is preferable. Specifically, ethylene-vinyl acetate-type, urethane-type, polyester-type, polyamide-type, and polyolefin-type hot-melt resin films are appropriate. More specifically, a polyolefin-type hot-melt film obtained by stretch-forming low molecular weight polypropylene or the like is particularly appropriate.

The second sound-absorbing material 20 is preferably selected from the same porous materials of the first sound-absorbing material 1, and may be the same as or different from the first sound-absorbing material 1, The second soft sound-insulating layer 30 is composed of a film being soft and having a non-air permeating property. The non-air permeating property, as an air permeability measured in accordance with JIS L1018-1999, is 10 cc/cm$^2$·sec or less, preferably 0.001 to 10 cc/cm$^2$·sec, and more preferably 0.01 to 1 cc/cm$^2$·sec.

In addition, the second soft sound-insulating layer 30 needs to have the Young's modulus measured in accordance with JIS K7127-1999 that is equal to or greater than five times or preferably equal to or greater than ten times that of the first soft sound-insulating layer. Since the second soft sound-insulating layer 30 is soft, it has a function to damp vibration of sound that has penetrated the second sound-absorbing material 20. In addition, a sound-insulating property is imparted thereto by also possessing rigidity with increasing Young's modulus within the range in which it can be deformed by vibration together with the sound-absorbing material 20 and by increasing the ratio of Young's modulus thereof to that of the first sound-insulating layer.

Furthermore, the second soft sound-insulating layer 30 is partially or entirely bonded to the second sound-absorbing material. Both of them may be bonded to each other by using an appropriate adhesive, but the second soft sound-insulating layer 30 preferably has an adhesion property. Incidentally, in the case where the bonding to the second sound-absorbing material is partial, the bonding area is preferably 50% or more of the contact area of the second sound-absorbing material and the second soft sound-insulating layer.

Considering such air permeability, Young's modulus, and bonding property, the second soft sound-insulating layer 30 is preferably a thermoplastic elastomer film, and particularly preferably a thermoplastic urethane elastomer film. In addition, as the thermoplastic urethane elastomer, one having the following structural formula (1), obtained by mixing a hard segment composed of an aromatic ring with a soft segment composed of $R_1$ (ester group-containing aliphatic hydrocarbon) can be mentioned.

[Chem. 1]

(1)

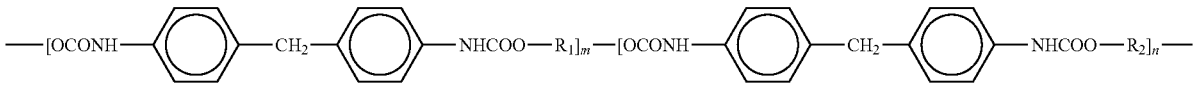

Incidentally, $R_1$ represents ester group-containing aliphatic hydrocarbon and $R_2$ represents a short-chain hydrocarbon (having 1 to 4 carbons). In addition, m and n are integers equal to or higher than 1.

Furthermore, the second soft sound-insulating layer 30 can be replaced with one obtained by coating and filling a sheet material such as nonwoven fabrics so as to have the above-described air permeability and Young's modulus. For example, use can be made of one obtained by coating a nonwoven fabric made of organic fibers such as polyester, polyamide or polypropylene with a resin such as urethane, acryl or silicone.

The sound-proof material of the present invention is one obtained by laminating the first sound-absorbing material 1, the first soft sound-insulating layer 10, the second sound-absorbing material 20, and the second soft sound-insulating layer 30, but in order to attain a light weight while ensuring a satisfactory sound-proof property, a total of the respective basis weights is preferably 2,000 g/m$^2$ or less. There is no limitation on the respective basis weight as long as the total basis weight is 2,000 g/m$^2$ or less, but the total basis weight of 2,000 g/m$^2$ or less is preferably attained with a basis weight of the first sound-absorbing material 1 of 250 to 1,000 g/m$^2$, a basis weight of the first soft sound-insulating layer 10 of 30 to 100 g/m$^2$, a basis weight of the second sound-absorbing material 30 of 150 to 500 g/m$^2$, and a basis weight of the second soft sound-insulating layer 30 of 30 to 1,000 g/m$^2$.

Figure 2:
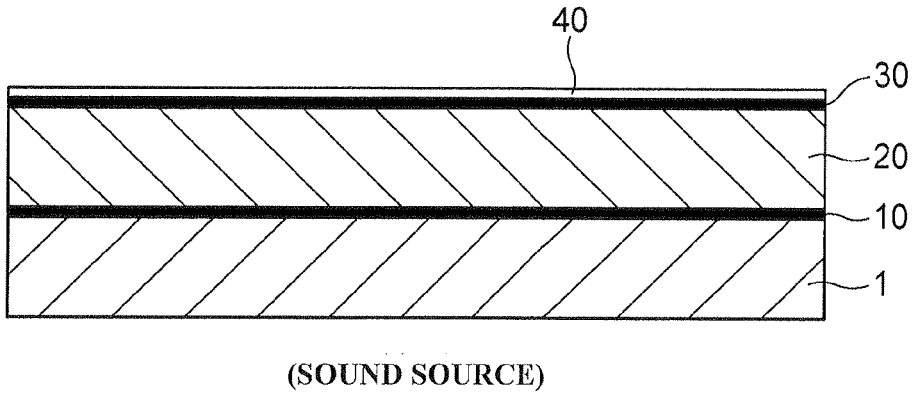
FIG. 2 is a cross-sectional view showing another example of the sound-proof material of the present invention.

In the sound-proof material of the present invention, a surface material 40 may be attached onto the second soft sound-insulating layer 30 as shown in FIG. 2. The surface material 40 is preferably one having an effect of increasing a shape retaining property of the sound-proof material and imparting a sound-insulating property, and a nonwoven fabric is preferably bonded. Specifically, there may be mentioned a nonwoven fabric obtained by laminating a foundation cloth produced by subjecting a polyethylene terephthalate short fabric to chemical bonding using a vinyl acetate resin and a cloth produced by welding polyester fibers by using a spun-bonding method.

Incidentally, in the case where the surface material 40 is attached, if a thermoplastic elastomer is used in the second soft sound-insulating layer 30, a combined material of the surface material 40 and the thermoplastic elastomer is formed due to the thermal fusion. Therefore, it is preferable to set the combined material to have an air permeability, Young's modulus, and basis weight to be within the range of those of the second soft sound-insulating layer 30 as described previously.

Figure 3:
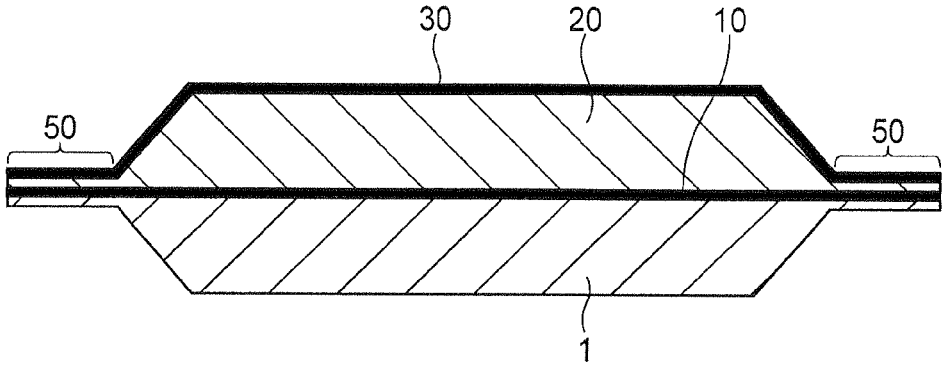
FIG. 3 is a cross-sectional view showing still another example of the sound-proof material of the present invention.

Further, peripheral edges of the sound-proof material of the present invention are preferably sealed. As a seal structure, peripheral edges 50 and 50 of the laminate can be pressure-bonded to each other using hot pressing as shown in FIG. 3. The peripheral edges may be compressed so as to have, for example, a width of 3 to 20 mm and a thickness of 0.5 to 2.5 mm. Also, a hot-melt sheet may be thermally fused on an end face (a thickness portion of the sound-proof material). Specifically, the end face of the laminate may be sealed by thermally welding a polyamide-type hot-melt film (having a thickness of 30 μm) at 170° C. Accordingly, leakage of sound to the outside through the end faces of the first sound-absorbing material 1 and the second sound-absorbing material 20 can be prevented. Incidentally, although not shown in the drawing, the peripheral edges can be sealed by pressure-bonding in the same manner even when the surface material 40 is attached.

Figure 4:
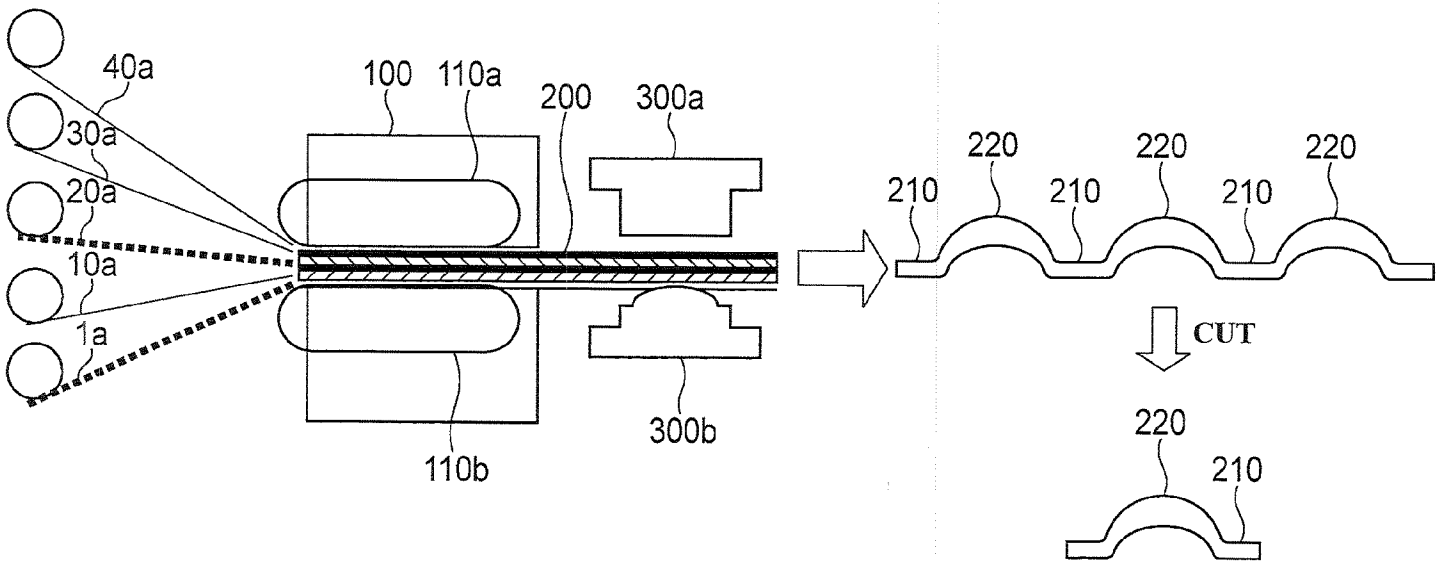
FIG. 4 is a schematic view describing an example of a production method of a sound-proof material according to the present invention.

Furthermore, the sound-proof material of the present invention may only be laminated as shown in the drawings, and can also be formed to a sound-proof molding having a three-dimensional shape (refer to FIG. 4). In order to obtain such a three-dimensional shape, a laminate may be heated in the state of holding a desired shape. Then, the laminate deformed due to heating is solidified in a normal temperature, and thereby the shape thereof is fixed.

The following method can be employed to produce the sound-proof material of the present invention. As shown in FIG. 4, first, a film 1*a* to form the first sound-absorbing material 1, a film 10*a* to form the first soft sound-insulating layer 10, a film 20*a* to form the second sound-absorbing material 20, and a film 30*a* to form the second soft sound-insulating layer 30, and, if necessary, a sheet 40*a* to form the surface material 40, all of which are long, are supplied from respective rolls to be input to an oven 100 in a laminated state. During passing through the oven 100, at least the film 20*a* to form the second sound-absorbing material 20 and the film 30*a* to form the second soft sound-insulating layer are thermally fused. Accordingly, a long laminate 200 that will serve as a sound-proof material is produced. Then, the laminate 200 is cut in a predetermined length, and the peripheral edges thereof are pressure-bonded to each other by thermal compression if necessary, and thereby a sound-proof material of the present invention is obtained. Incidentally, the oven 100 has a structure in which a pair of upper and lower conveyers 110*a* and 110*b* are disposed therein, and pull the film 1*a* to form the first sound-absorbing material 1, the film 10*a* to form the first soft sound-insulating layer 10, the film 20*a* to form the second sound-absorbing material 20, the film 30*a* to form the second soft sound-insulating layer 30, and the sheet 40*a* to form the surface material 40 into the oven from the respective rolls. Here, there are no particular limitations on the conveyer speed, the temperature and length of the oven, and the like, but for example, the conveyer speed may be 1 to 3 m/min., the temperature may be 190 to 220° C., and the length of the oven may be 5 to 20 m.

In addition, in the case of molding into a three-dimensional shape, a pair of upper and lower molding dies 300*a* and 300*b* are disposed in the latter stage of the oven 100 and the laminate 200 discharged from the oven 100 is thermally compressed to mold into a three-dimensional shape. In this stage, portions 210 that have been thermally compressed can be set to be flat portions, and portions 220 that are not thermally compressed other portion and remains laminated can be formed into a three-dimensional shape such as a circular arc shape. Then, by cutting the thermally compressed portions 210, sound-proof moldings of which cross-sections are circular arc shape and peripheral edges are sealed through thermal compression can be obtained. The thermal compression can be performed, for example, at a temperature in a range of 180 to 200° C. for 10 to 30 seconds, although it depends upon the desired shape and thickness of the laminate.

In the above-described production method, by changing the molding dies 300*a* and 300*b* to heat-pressing devices, molding into a three-dimensional shape at can be performed the same time as bonding without using the oven 100.

In the case where the sound-proof material of the present invention is used in the state not molded into a three-dimensional shape as shown in FIGS. 1 to 3, it is properly used in buildings, for example, used so as to be interposed between an inner wall material and an outer wall material. In addition, it can be attached to sound sources such as engines, transmissions and motors of automobiles, motorcycles, vessels, and the like. In such a case, for example, a sound-proof material thicker than a gap between an engine and an engine cover may be used, the first sound-absorbing material thereof is placed on the engine, and it is compressed when the engine cover is mounted thereon, whereby the gap between the engine and the engine cover can be filled.

Further, a sound-proof molding molded into a three-dimensional shape can be molded to coincide with, for example, the external shape of an engine and mounted on the engine while bringing the first sound-absorbing material thereof into contact with the engine. Due to such a structure, sealed sound-insulation of a sound emitted from an engine surface to the air and insulation of a solid-borne sound (vibration) are realized, and an improvement of a sound-proof effect is expected.

EXAMPLES

Hereinafter, the present invention will be further described exemplifying examples and comparative examples, but the present invention is not limited thereto. Incidentally, air permeability was measured in accordance with JIS L1018, and the Young's modulus was measured in accordance with JIS K7127-1999. In addition, a basis weight is a mass per 1 m×1 m.

Test 1

Example 1

Polyethylene terephthalate felt (a basis weight of 500 g/m$^2$) having a thickness of 10 mm as a first sound-absorbing material and a second sound-absorbing material, a hot-melt film (air permeability of 0.01 cc/cm$^2$·sec, a Young's modulus of 80 MPa and a basis weight of 80 g/m$^2$: a polyolefin-type hot-melt film obtained by stretch-forming a low molecular weight polypropylene or the like) having a thickness of 30 μm as a first soft sound-insulating layer, a thermoplastic urethane elastomer film (air permeability of 0.001 cc/cm$^2$·sec, a Young's modulus of 1,000 MPa and a basis weight of 36 g/m$^2$: a polyester-type thermoplastic urethane elastomer film obtained by mixing a hard segment including an aromatic ring and a soft segment including $R_1$ (ester group-containing aliphatic hydrocarbon) as shown in the structural formula (1) described above) having a thickness of 30 μm as a second soft sound-insulating layer, and a polyester nonwoven fabric (air permeability of 110 cc/cm$^2$·sec, a Young's modulus of 200 MPa and a basis weight of 220 g/m$^2$: a nonwoven fabric obtained by laminating a foundation cloth produced by subjecting a polyethylene terephthalate short fabric to chemical bonding using a vinyl acetate resin, and a cloth obtained by welding polyester fibers by using a spun-bonding method) as a surface material were prepared.

Then, the first soft sound-insulating layer, the second sound-absorbing material, the second soft sound-insulating layer, and the surface material were laminated on one face of the first sound-absorbing material in this order, the entire was heated in an oven so that all interfaces were bonded to each other, to thereby produce a sound-proof material. The state of bonding of the interfaces was entire-face bonding (100% of bonded area).

Example 2

A sound-proof material was produced in the same manner as in Example 1 except that one obtained by performing urethane-coating on polyester nonwoven fabric was used as the second soft sound-insulating layer.

Comparative Example 1

A sound-proof material was produced by using the same materials as those in Example 1 merely by laminating them without bonding the interfaces.

Figure 5:
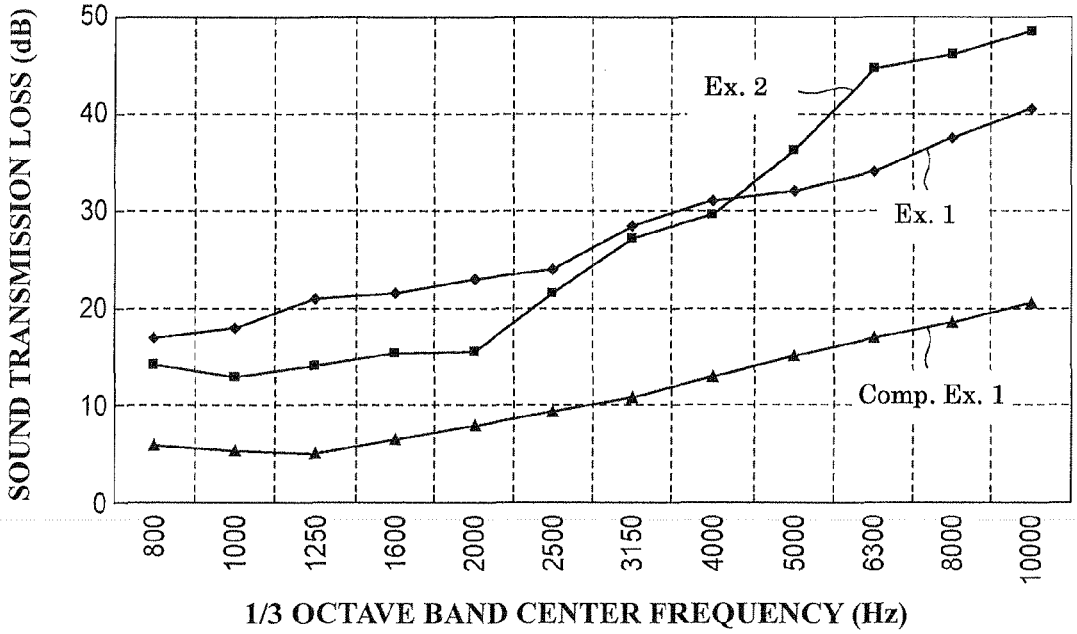
FIG. 5 is a graph showing the result of Test 1.

Sound transmission losses of the sound-proof materials of Examples 1 and 2 and Comparative Example 1 were measured by using a small size reverberation box (diffuse sound field) in an anechoic chamber (free sound field) in accordance with a sound intensity method. Schematically describing the test method, the measurement system includes (1) a sound source side (the small size reverberation box; diffuse sound field), (2) a test sample, and (3) a sound reception side (the anechoic chamber; free sound field). The computed values obtained by subtracting values (B) of the energy of transmitted sound emitted from a surface of (2) toward (3) measured using an intensity microphone (directional microphone) constituted by a pair of microphones from the energy of sound (A) incident on (2) from (1), were taken as sound transmission losses. The results are shown in FIG. 5, and it can be found that a sound-insulation property is increased by bonding the interfaces with each other.

Test 2

Examples 3 to 10 and Comparative Examples 2 to 7

Sound-proof materials were produced by laminating a first sound-absorbing material, a first soft sound-insulating layer, a second sound-absorbing material, a second soft sound-insulating layer, and a surface material as shown in Tables 1 to 3, and heating in an oven. Incidentally, in Comparative Examples 2 to 4, the second sound-absorbing material and a second soft sound-insulating layer were not bonded to each other. In addition, the peripheral edges of the sound-proof material were sealed by heat-pressing except in Examples 8 to 10. Then, sound transmission losses were measured in the same manner as in Test 1. Incidentally, the materials of the sound-absorbing materials, the soft sound-insulating layers, and the surface materials in Tables 1 to 3 are the same as those in Example 1 described above unless specified otherwise. In addition, the indication "Present" with regard to bonding between materials in Tables 1 to 3 means the state of entire-face bonding. Moreover, bonding of (2) the first soft sound-insulating layer/(3) the second sound-absorbing material in Tables 1 to 3 is entire-face bonding.

TABLE 1

| | Example 3 | Example 4 | Example 5 | Example 6 |
|---|---|---|---|---|
| (1) First sound-absorbing material | PET felt: 10 mm (Basis weight: 500 g/m$^2$) | PET felt: 10 mm (Basis weight: 500 g/m$^2$) | PET felt: 10 mm (Basis weight: 500 g/m$^2$) | PET felt: 10 mm (Basis weight: 500 g/m$^2$) |
| (2) First soft sound-insulating layer | Hot-melt film: 30 μm | Hot-melt film: 30 μm | Hot-melt film: 30 μm | Hot-melt film: 30 μm |
| (3) Second sound- | PET felt: 10 mm | PET felt: 10 mm | PET felt: 10 mm | PET felt: 10 mm |

TABLE 1-continued

Figure 6:
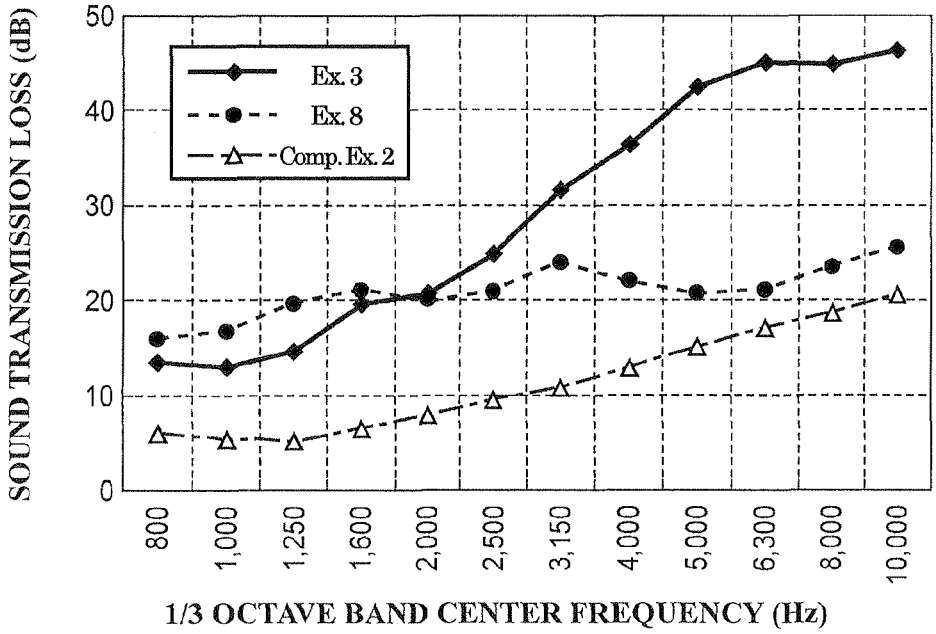
FIG. 6 is a graph showing the results of Example 3, Example 8 and Comparative Example 2 in Test 2.
Figure 7:
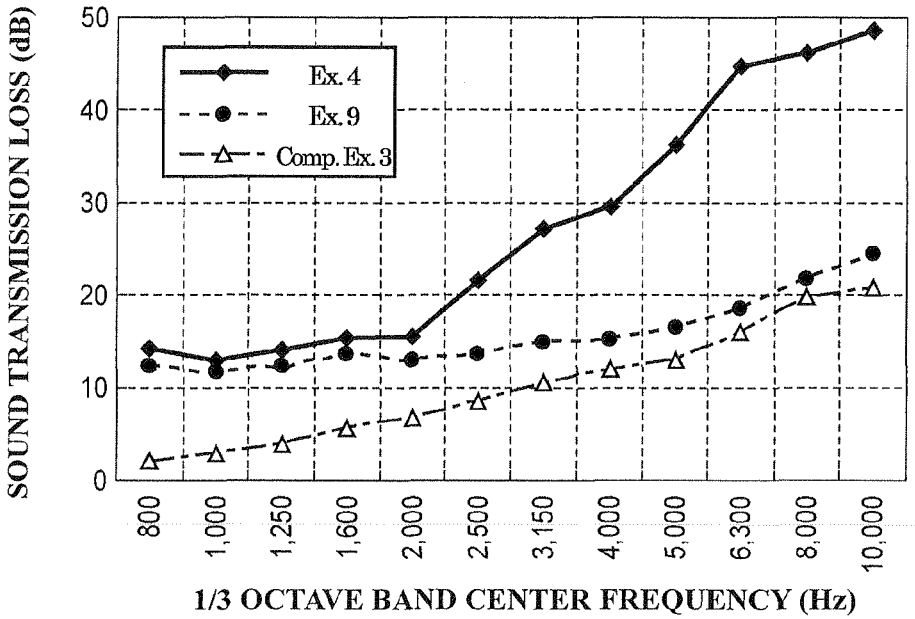
FIG. 7 is a graph showing the results of Example 4, Example 9 and Comparative Example 3 in Test 2.
Figure 8:
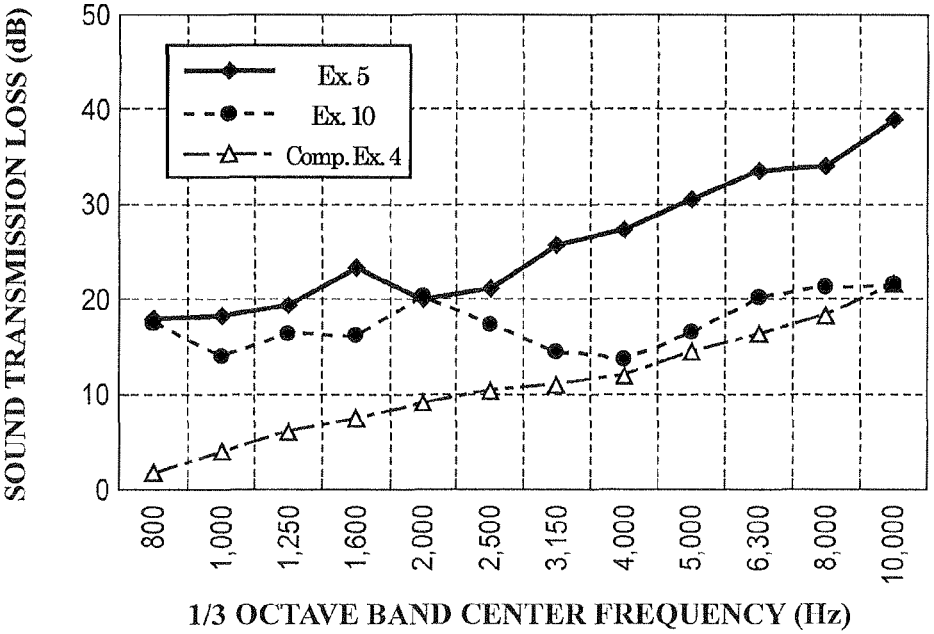
FIG. 8 is a graph showing the results of Example 5, Example 10 and Comparative Example 4 in Test 2.
Figure 9:
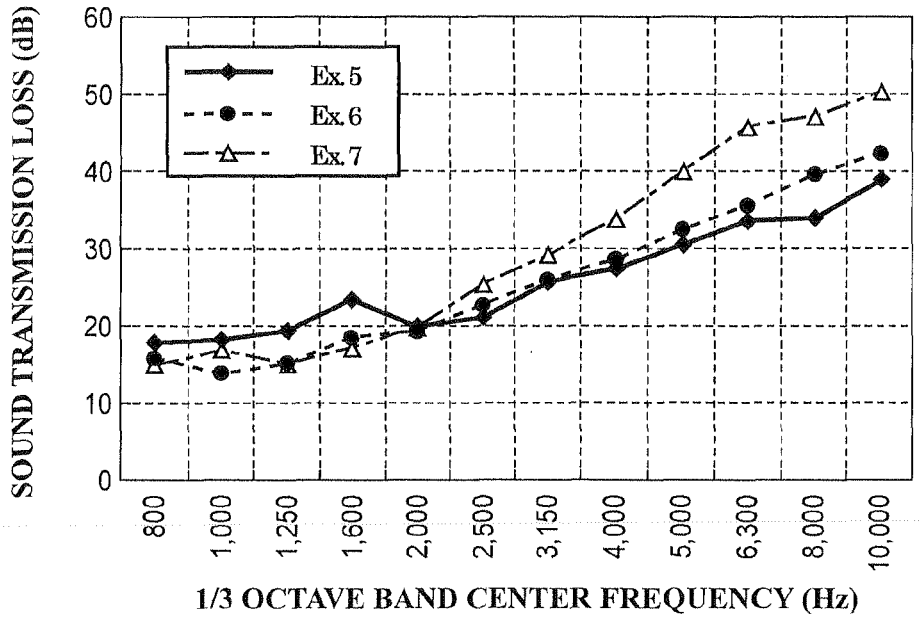
FIG. 9 is a graph showing the results of Example 5, Example 6 and Example 7 in Test 2.

| | Example 3 | Example 4 | Example 5 | Example 6 |
|---|---|---|---|---|
| absorbing material | (Basis weight: 500 g/m$^2$) | (Basis weight: 500 g/m$^2$) | (Basis weight: 500 g/m$^2$) | (Basis weight: 500 g/m$^2$) |
| (4) Second soft sound-insulating layer | Thermoplastic elastomer film: 30 μm | Thermoplastic elastomer film: 30 μm | Thermoplastic elastomer film: 30 μm | Thermoplastic elastomer film: 100 μm |
| (5) Surface material | Polyester nonwoven fabric (Basis weight: 220 g/m$^2$) | Polyester nonwoven fabric (Basis weight: 125 g/m$^2$) | — | — |
| (6) Seal of peripheral edges | Press-bonding of edge portions by heat press molding | Press-bonding of edge portions by heat press molding | Press-bonding of edge portions by heat press molding | Press-bonding of edge portions by heat press molding |
| Bonding of (1) to (2) | Present | Present | Present | Present |
| Bonding of (3) to (4) | Present | Present | Present | Present |
| Bonding of (4) to (5) | Present | Present | — | — |
| Young's modulus of (2) (MPa) | 80 | 80 | 80 | 80 |
| Young's modulus of (4) or (4) + (5) (MPa) | 1,000 | 700 | 500 | 800 |
| Ratio between Young's moduli (2)/((4) + (5)) | 12.5 | 8.8 | 6.3 | 10.0 |
| Basis weight (g/m$^2$) | 1336 | 1241 | 1116 | 1200 |
| Sound transmission loss | FIG. 6 | FIG. 7 | FIG. 8/FIG. 9 | FIG. 9 |

TABLE 2

| | Example 7 | Example 8 | Example 9 | Example 10 |
|---|---|---|---|---|
| (1) First sound-absorbing material | PET felt: 10 mm (Basis weight: 500 g/m$^2$) | PET felt: 10 mm (Basis weight: 500 g/m$^2$) | PET felt: 10 mm (Basis weight: 500 g/m$^2$) | PET felt: 10 mm (Basis weight: 500 g/m$^2$) |
| (2) First soft sound-insulating layer | Hot-melt film: 30 μm | Hot-melt film: 30 μm | Hot-melt film: 30 μm | Hot-melt film: 30 μm |
| (3) Second sound-absorbing material | PET felt: 10 mm (Basis weight: 500 g/m$^2$) | PET felt: 10 mm (Basis weight: 500 g/m$^2$) | PET felt: 10 mm (Basis weight: 500 g/m$^2$) | PET felt: 10 mm (Basis weight: 500 g/m$^2$) |
| (4) Second soft sound-insulating layer | Thermoplastic elastomer film: 500 μm | Thermoplastic elastomer film: 30 μm | Thermoplastic elastomer film: 30 μm | Thermoplastic elastomer film: 30 μm |
| (5) Surface material | — | Polyester nonwoven fabric (Basis weight: 220 g/m$^2$) | Polyester nonwoven fabric (Basis weight: 125 g/m$^2$) | — |
| (6) Seal of peripheral edges | Press-bonding of edge portions by heat press molding | None | None | None |
| Bonding of (1) to (2) | Present | Present | Present | Present |
| Bonding of (3) to (4) | Present | Present | Present | Present |
| Bonding of (4) to (5) | — | Present | Present | — |
| Young's modulus of (2) (MPa) | 80 | 80 | 80.00 | 80 |
| Young's modulus of (4) or (4) + (5) (MPa) | 1,200 | 1,000 | 700 | 500 |
| Ratio between Young's moduli (2)/((4) + (5)) | 15.0 | 12.5 | 8.8 | 6.3 |
| Basis weight (g/m$^2$) | 1680 | 1336 | 1241 | 1116 |
| Sound transmission loss | FIG. 9 | FIG. 6 | FIG. 7 | FIG. 8 |

TABLE 3

| | Comp. Ex. 2 | Comp. Ex. 3 | Comp. Ex. 4 | Comp. Ex. 5 | Comp. Ex. 6 | Comp. Ex. 7 |
|---|---|---|---|---|---|---|
| (1) First sound-absorbing material | — | PET felt: 10 mm (Basis weight: 500 g/m$^2$) | PET felt: 10 mm (Basis weight: 500 g/m$^2$) | PET felt: 10 mm (Basis weight: 500 g/m$^2$) | PET felt: 10 mm (Basis weight: 1,000 g/m$^2$) | — |
| (2) First soft sound-insulating layer | Hot-melt film: 30 μm | Hot-melt film: 30 μm | Hot-melt film: 30 μm | Hot-melt film: 50 μm | Hot-melt film: 30 μm | — |
| (3) Second sound-absorbing material | PET felt: 10 mm (Basis weight: 500 g/m$^2$) | PET felt: 10 mm (Basis weight: 500 g/m$^2$) | PET felt: 10 mm (Basis weight: 500 g/m$^2$) | PET felt: 10 mm (Basis weight: 500 g/m$^2$) | PET felt: 10 mm (Basis weight: 1,000 g/m$^2$) | Urethane foam: 10 mm (Basis weight: 500 g/m$^2$) |
| (4) Second soft sound-insulating layer | Thermoplastic elastomer film: | Thermoplastic elastomer film: | Thermoplastic elastomer film: | Thermoplastic elastomer film: | Thermoplastic elastomer film: | PP resin plate: 2 mm |

TABLE 3-continued

Figure 10:
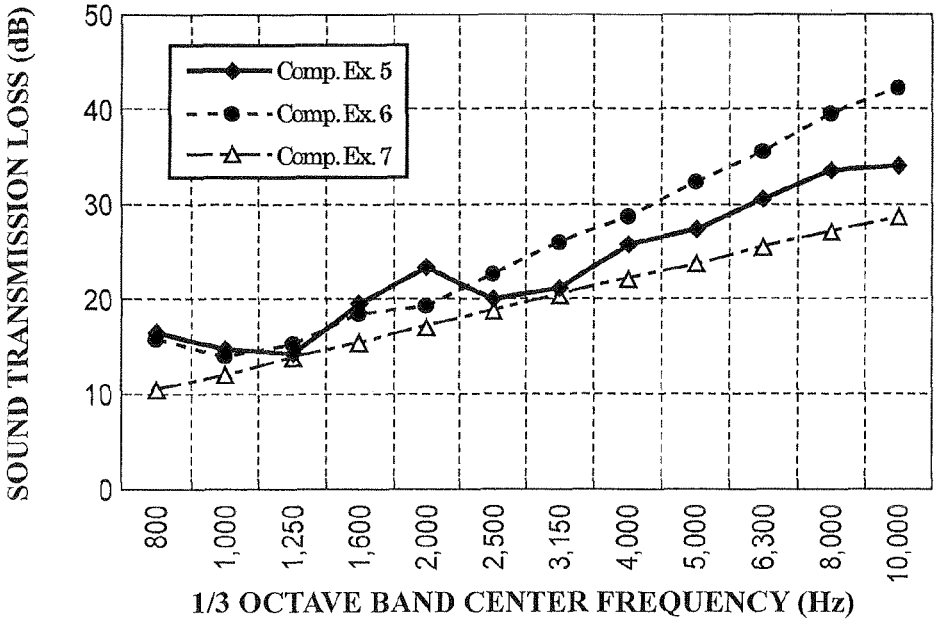
FIG. 10 is a graph showing the results of Comparative Example 5, Comparative Example 6 and Comparative Example 7 in Test 2.

| | Comp. Ex. 2 | Comp. Ex. 3 | Comp. Ex. 4 | Comp. Ex. 5 | Comp. Ex. 6 | Comp. Ex. 7 |
|---|---|---|---|---|---|---|
| | 30 μm | 30 μm | 30 μm | 30 μm | 30 μm | |
| (5) Surface material | Polyester nonwoven fabric (Basis weight: 220 g/m$^2$) | Polyester nonwoven fabric (Basis weight: 125 g/m$^2$) | — | — | Polyester nonwoven fabric (Basis weight: 220 g/m$^2$) | — |
| (6) Seal of peripheral edges | Press-bonding of edge portions by heat press molding | Press-bonding of edge portions by heat press molding | Press-bonding of edge portions by heat press molding | Press-bonding of edge portions by heat press molding | Press-bonding of edge portions by heat press molding | — |
| Bonding of (1) to (2) | — | Present | Present | Present | Present | — |
| Bonding of (3) to (4) | None | None | None | Present | None | None |
| Bonding of (4) to (5) | None | None | — | — | None | — |
| Young's modulus of (2) (MPa) | 80 | 80 | 80 | 120 | 80 | — |
| (Young's modulus of (4) or (4) + (5) (MPa) | 1,000 | 700 | 500 | 500 | 1,000 | 12,000 |
| Ratio between Young's moduli (2)/((4) + (5)) | 12.5 | 8.8 | 6.3 | 4.2 | 12.5 | — |
| (Basis weight (g/m$^2$) | 1336 | 1241 | 1116 | 1169 | 2336 | 2300 |
| (Sound transmission loss | FIG. 6 | FIG. 7 | FIG. 8 | FIG. 10 | FIG. 10 | FIG. 10 |

The results are shown in FIGS. 6 to 10, and it can be found that sound-proof materials obtained by laminating a first sound-absorbing material, a first soft sound-insulating layer, a second sound-absorbing material, and a second soft sound-insulating layer and bonding at least the second sound-absorbing material and the second soft sound-insulating layer to each other according to the present invention exhibit excellent sound-proof property.

While the present invention has been described in detail and with reference to specific embodiments thereof, it will be apparent to one skilled in the art that various changes and modifications can be made therein without departing from the spirit and scope thereof.

The present invention is based on Japanese Patent Application No. 2011-014515 filed on Jan. 26, 2011, the entire content of which is incorporated hereinto by reference. In addition, all references cited in the present specification are incorporated herein by reference.

DESCRIPTION OF REFERENCE NUMERALS AND SIGNS

1 First sound-absorbing material
10 First soft sound-insulating layer
20 Second sound-absorbing material
30 Second soft sound-insulating layer
40 Surface material

The invention claimed is:

1. A sound-proof material comprising:

a first sound-absorbing material disposed facing a sound source;

a first soft sound-insulating layer laminated on a face of the first sound-absorbing material opposite to the sound source, and having an air permeability measured in accordance with JIS L1018 of 10 cc/cm$^2$·sec or lower;

a second sound-absorbing material laminated on the first soft sound-insulating layer; and a second soft sound-insulating layer laminated on the second sound-absorbing material, and having an air permeability measured in accordance with JIS L1018 of 10 cc/cm$^2$·sec or lower and a Young's modulus measured in accordance with JIS K7127 greater than or equal to five times that of the first soft sound-insulating layer within the range in which it can be deformed by vibration together with the sound-absorbing material, wherein at least the second soft sound-insulating layer is partially or entirely bonded to the second sound-absorbing material.

2. The sound-proof material according to claim 1, wherein the total of the basis weights of the first sound-absorbing material, the first soft sound-insulating layer, the second sound-absorbing material, and the second soft sound-insulating layer is 2,000 g/m$^2$ or less.

3. The sound-proof material according to claim 1, wherein the second soft sound-insulating layer is made of a thermoplastic elastomer film.

4. The sound-proof material according to claim 1, wherein peripheral edges thereof are sealed.

5. A sound-proof molding obtained by molding the sound-proof material described in claim 1 into a three-dimensional shape.

6. A method for producing a sound-proof material comprising:

a laminating step of laminating, on a first sound-absorbing material, a first soft sound-insulating film comprising a thermoplastic resin and having an air permeability measured in accordance with JIS L1018 of 10 cc/cm$^2$·sec or lower, a second sound-absorbing material, and a second soft sound-insulating film comprising a thermoplastic resin and having an air permeability measured in accordance with JIS L1018 of 10 cc/cm$^2$·sec or lower and a Young's modulus measured in accordance with JIS K7127 greater than or equal to five times that of the first soft sound-insulating layer within the range in which it can be deformed by vibration together with the sound-absorbing material, in this order, to obtain a laminate; and a bonding step of performing a heat process on the obtained laminate, to partially or entirely bond at least the second soft sound-insulating layer and the second sound-absorbing material with each other.

7. The production method of a sound-proof material according to claim 6, further comprising: a molding step of molding the laminate into a three-dimensional shape after the bonding step.

8. A method for producing a sound-proof material comprising:

a laminating step of laminating, on a first sound-absorbing material, a first soft sound-insulating film comprising a thermoplastic resin and having an air permeability measured in accordance with JIS L1018 of 10 cc/cm$^2$·sec or lower, a second sound-absorbing material, and a second soft sound-insulating film comprising a thermoplastic resin and having an air permeability measured in accordance with JIS L1018 of 10 cc/cm$^2$·sec or lower, a second sound-absorbing material, and a second soft sound-insulating film comprising and a Young's modulus measured in accordance with JIS K7127 greater than or equal to five times that of the first soft sound-insulating layer within the range in which it can be deformed by vibration together with the sound-absorbing material, in this order, to obtain a laminate; and a bonding step of performing a heat-compression on the obtained laminate to mold into a three-dimensional shape and partially or entirely bonding at least the second soft sound-insulating layer and the second sound-absorbing material with each other.

9. A sound-proof method in which the sound-proof material described in claim 1 is disposed so that the first sound-absorbing material is in contact with the sound source.

* * * * *